United States Patent [19]

Baranowski

[11] Patent Number: 4,538,314

[45] Date of Patent: Sep. 3, 1985

[54] BOARDING RAMP

[75] Inventor: Kenneth M. Baranowski, 71020 Weeks Rd., Richmond, Mich. 48602

[73] Assignee: Kenneth M. Baranowski, Kendallville, Ind.

[21] Appl. No.: 511,013

[22] Filed: Jul. 5, 1983

[51] Int. Cl.[3] ..... E01D 1/00

[52] U.S. Cl. ..... 14/71.1; 114/362; 182/97; 182/194; 182/206

[58] Field of Search ..... 14/69.5, 71.1, 72.5; 182/206, 91, 97, 194, 48; 114/362, 343, 364; 119/82

[56] References Cited

U.S. PATENT DOCUMENTS

| | | | |
|---|---|---|---|
| D. 243,854 | 3/1977 | Pelkey | D25/63 |
| 1,270,903 | 7/1918 | Weismantel | 114/375 |
| 2,821,726 | 2/1958 | Correll | 114/343 X |
| 2,964,767 | 12/1960 | Egbert | 14/71.1 |
| 3,063,415 | 12/1962 | Chapman | 119/29 |
| 3,159,141 | 12/1964 | Paterek | 119/29 |
| 3,570,029 | 3/1971 | Hunsaker | 114/362 |
| 3,587,123 | 6/1971 | O'Boyle | 114/362 |
| 3,794,140 | 2/1974 | Sell | 182/92 |
| 3,883,910 | 5/1975 | Naylor, III | 114/355 |
| 3,891,053 | 6/1975 | Burton | 182/97 |
| 3,892,290 | 7/1975 | Lang | 182/206 X |
| 4,186,820 | 2/1980 | Cosman et al. | 182/93 |
| 4,230,202 | 10/1980 | Kudra, III | 182/194 X |
| 4,293,967 | 10/1981 | Ord | 114/362 |

*Primary Examiner*—James A. Leppink
*Assistant Examiner*—Beverly E. Hjorth
*Attorney, Agent, or Firm*—Harness, Dickey & Pierce

[57] ABSTRACT

A removable and adjustable ramp for aiding an animal or human into a small boat from water in which the boat is floating comprising an inclined planar member removably attached to the vertical wall portion of a small boat and extending into the water with an integrally associated platform wherein said platform is disposed in a substantially horizontal position when said inclined planar member is touched by a forward portion of the animal or human to accommodate a rearward portion of the animal or human to ease access of the animal or human onto the boat without external aid. The ramp is adjustable to accommodate various sizes and weights of animals and humans. The ramp is lightweight, portable, and may include additional access aids such as indentations and low slip surfaces on the ramp.

13 Claims, 2 Drawing Figures

BOARDING RAMP

BACKGROUND AND SUMMARY OF THE INVENTION

The present invention relates generally to means for gaining access to boats from a position in the water surrounding the boat and more particularly to a ramp for gaining access to a small boat by an animal, such as a hunting dog, with an optional capability of gaining access to a small boat by a human being.

Ease of access from the water surrounding a boat into the boat by a person or an animal has proven to be a problem, particular where the water is not shallow and the human or animal cannot use the water bottom to aid in boarding the boat. This problem is particularly notable with respect to gaining access to canoes or small boats such as those used by duck hunters. A boat will move and roll with each movement of the person or animal attempting to gain access to the boat. Vertical ladders have been used in some applications for access by humans, but ladders cannot be readily used by four-legged animals, such as hunting dogs. Other types of ladders or ramps, such as the horizontal boarding device of U.S. Pat. No. 3,587,123 or the inclined ladder of U.S. Pat. No. 3,891,053, have attempted to make access to a boat easier, but have several practical problems which prevent their efficacy and universal use for both humans and animals.

Hunters that shoot over water generally have facilitated retrieval of the game, such as ducks, that they have shot by the use of a dog to find the game, acquire it, and bring it to the hunter in the boat. Generally, a dog is trained to retain the game in its mouth until the dog is into the boat. The dog is usually incapable of boarding the boat without assistance from the hunter. Since duck hunting season occurs generally in temperature climates when the water is very cold, at least in the more northern climates, the hunter must not only risk getting wet from the animal itself, but also places himself dangerously over the boat edge to lift the dog over the rail of the boat and faces the potential problem of landing in the water himself.

The dog, in turn, is handled in a very uncomfortable manner as it is grabbed by the hunter and physically lifted into the boat. Throughout this process, the hunter also has to worry about not displacing any other objects in the boat, such as his gun, food pack, etc., which may fall into the water as the boat rolls and jostles its cargo.

Dog ladders, such as that disclosed in U.S. Pat. No. 3,891,053, have not functioned adequately and still need the aid of the hunter. It has been determined in development of the present invention that as soon as a dog touches any part of the boat or any kind of ramp ("touch point"), its hind legs drop deeper into the water. The dog's "touch point" is generally at or below the water level. With a ramp such as that shown by U.S. Pat. Nos. 3,891,053 or 3,587,123, the dog will drop its hind legs deeper into the water as soon as it touches the ramp with its front paws and will not be able to climb the ramp without aid of the hunter unless the advantages of the present invention are provided.

The present invention provides a ramp fitted to a variety of hunting dogs which provides easy access to the hunter's boat from any direction relative to the boat. Also, the present invention permits the dog to have access to the boat without any aid needed for the hunter. The present invention is designed so that the hunter may be positioned anywhere in the boat, although the invention works optimally if the hunter sits on the opposite side of the boat that the ramp is attached. In fact, the hunter need not even be in the boat that the dog is boarding, in case game is being hunted from one position and the dog returns the game to a boat in a second position for storage during the hunt.

The present invention also has the advantage that the ramp may be used as a portable stand in shallow water since it is capable of standing alone in a self-supporting manner on the bottom of the watershed either connected or unconnected to the boat if the water is shallower than the height of the ramp.

To be effective, the ramp of the present invention is also light weight and portable. Also, the ramp is adjustable to accommodate various types of boats in relation to various types and sizes of dogs. All of the above features are offered in a ramp that also facilitates boarding a small boat or canoe by humans. With humans, the device is even more effective with a slightly larger boat, such as a ski boat, where due to the weight and larger size of the boat, counterbalance is not a consideration.

Other objects and advantages of the present invention will become apparent in the following detailed description taken in conjunction with the accompanying drawings.

DETAILED DESCRIPTION OF THE PREFERRED EMBODIMENTS

Figure 1:
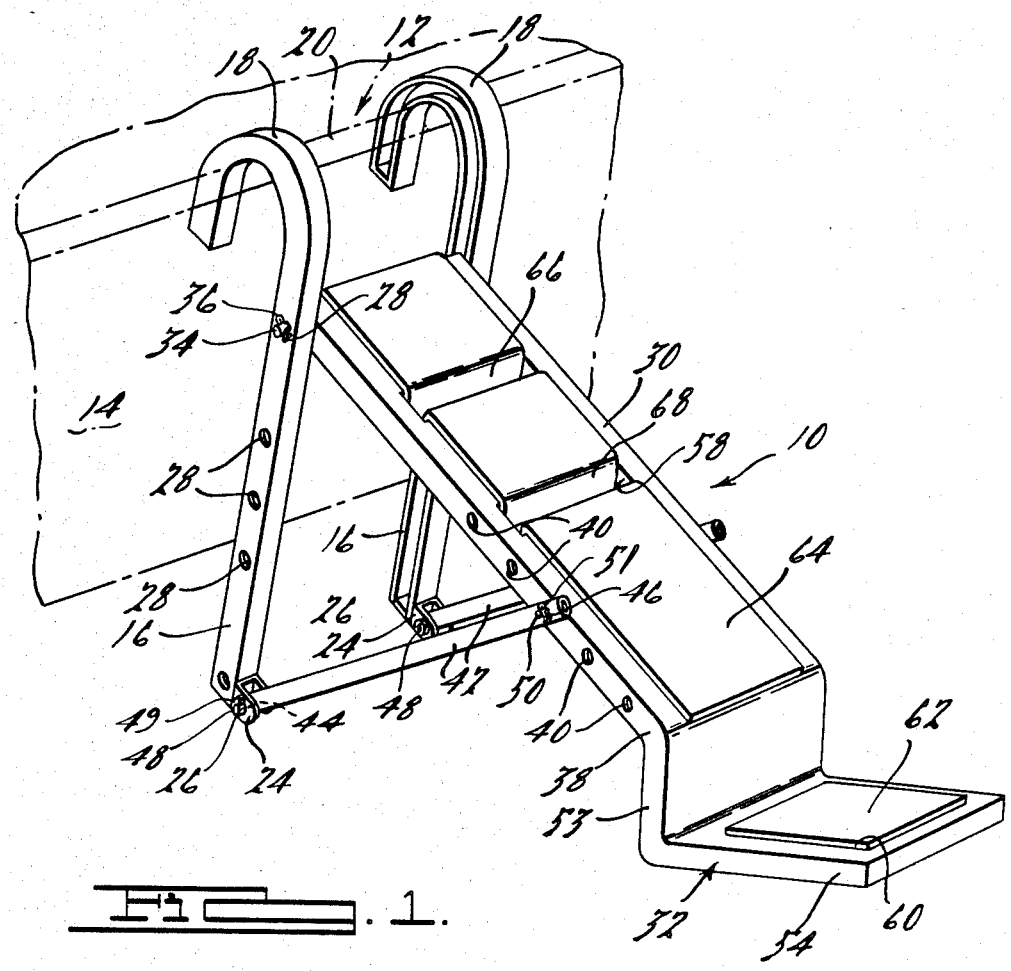
FIG. 1 is an elevated perspective view of a ramp of the present invention as mounted on the side of a small boat.
Figure 2:
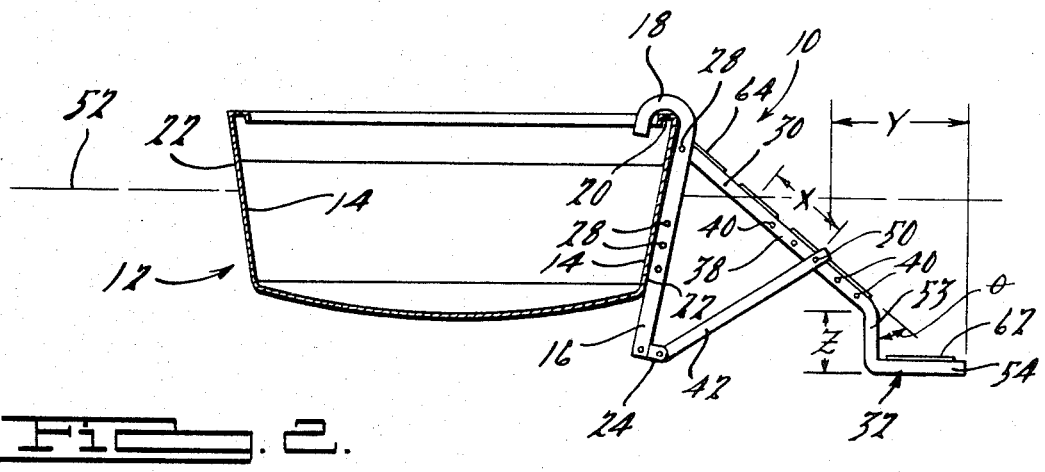
FIG. 2 is a front view of the invention set forth in FIG. 1 with the boat in section.

Referring to FIGS. 1 and 2, the ramp 10 of the present invention is illustrated removably mounted to a small boat 12, such as the type of boat used in duck hunting. The ramp 10 is mounted over the side 14 of the boat 12 by a pair of support arms 16 each having an upper hook portion 18 which encompasses the top lip 20 of the side 14 of the boat 12. When mounted to the boat 12, each support arm 16 extends substantially vertically downwardly abutting the outer surface 22 of the side 14 of the boat 12 to which it is attached. The arms 16 illustrated are each formed of molded fiberglas. Any rigid high strength, lightweight plastic or metal, however, is a suitable material for the arms 16.

At the lower part of each arm 16, a U-shaped aluminum bracket 24 is fixedly attached, which bracket 24 includes apertures 26. A plurality of adjustment apertures 28 are also included at spaced apart locations along the length of each arm. Each aperture 28 on one of the arms has a corresponding aperture 28 on the other arm.

A substantially planar portion 30 forms the central part of the ramp 10. The planar portion 30 is again formed of fiberglas or other high strength, lightweight plastic or metal and has an integral substantially L-shaped mounting platform 32 at one end thereof. The other end of the planar portion 30 has an attachment mechanism comprising a pair of pins 34 which are integrated with the planar portion 30 and insertable in correspondent apertures 28 in the support arms 16. A cotter pin 36 or other securement mechanism rotatably affixes the planar portion 30 and the pins 34 to the support arms 16 at selected locations based upon the apertures 28 selected for the pins 34.

The planar portion 30 includes sidewalls 38 each having a plurality of apertures 40. Two braces 42, having apertures 44 and 46, one at each end of each brace 42, extend between the brackets 24 of the support arms 16 and the planar portion sidewalls 38. A screw 48 and nut 49 extends through the apertures 26 of each bracket 24 and the apertures 44 of each brace 42 (with the head interior to the sidewall 38) to rotatably affix the brace to the support arm 16 at the bracket 24. A second pin 50 also with a head (not shown) disposed interior of the support arms 16 secures the other end of each brace 42 through aperture 46 to one of a selected correspondent pair of apertures 40 (one in each sidewall 38) via a removable retaining clip 51 or the like.

The boat sidewall 14, support arms 16, braces 42 and the planar portion 30 all interact to provide a variety of angular positions of the planar portion relative to the water surface 52 or other point of reference via the apertures 28 in the support arms, the aperture 40 in the planar portion sidewalls 44 and the corresponding pins.

When the ramp 10 is disposed on the boat 12, the integral mounting platform 32 is disposed below the water surface 52. The platform 32 has a vertical wall 53 and a horizontal base 54 which form substantially a right angle with one another. Significantly, however, the plane formed by the planar portion 30 forms an angle $\phi$ with the vertical wall 53 of the platform 32 which is not a right angle. In the preferred embodiment the angle $\phi$ is 55 degrees. A range of 40 degrees to 70 degrees has been found to be satisfactory.

When a hunting dog approaches the boat, the first part of the dog to touch the ramp would be its front paws. The paws will normally touch in a range between the water surface and within six inches of the water surface, as shown by X in FIG. 2. As soon as the dog touches the ramp 10, its hind end and back legs drop deeper into the water. With the present invention, the hind end and back legs of the dog drop onto the platform 32 if the distances Y (from the lower range of the touch point zone X) and Z (the height of the vertical wall 53 of the platform 32) are appropriate. An appropriate dimension for Y is anything greater than the distance between the dog's front and back legs in a standing position. The dimension Z should be substantially less than the Y dimension and approximately the length or less than the length of a dog's legs when in a standing position. It should be noted that although the above design parameters are optimal, a longer ramp may still work for a smaller dog and also a larger dog may be taught to tuck in its hind legs to use a smaller than optimum ramp.

As the dog touches the ramp 10, the boat 12 will also roll toward the dog. Thus, the angle $\phi$ is important to place the platform 32 below the dog at an appropriate substantially horizontal position.

For a seventy-five pound dog, which is believed to be an average hunting dog, an angle $\phi$ of 55 degrees, a Z dimension of six inches and a Y dimension of approximately 30 inches, with a total planar portion length of 40 inches has achieved significant results.

It shuld be noted that the touch point and Y dimension varies with the selection of adjustment apertures 28, 44 and 46 in various combinations. The selection of the various apertures depends on the distance from lip 20 of the boat sidewall 14 to water surface, the pitch of the sidewall 14 of the boat with the horizontal, and the roll characteristics of the boat selected (dependent on the width of boat, weight of boat, etc.). The weight of the dog should not play a major part since the inertia of the boat and short length of the ramp 10 should counteract any dogs up to 150 pounds or even more.

The planar portion 30 and the platform 32 of the ramp 10 each may include countersink areas 58 and 60, respectively, within which plastic or fiber looped carpets 62 and 64, respectively (or similar rough surface having low slip characteristics), are suitably affixed by a water-resistant adhesive. The carpets 62 and 64 will aid the animal or human in climbing the ramp 10. Also, two optional indentations 66 and 68 are included in the planar portion 30 of the ramp 10 to act as footing for the animal or human progressing up the ramp.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

I claim:

1. A ramp for aiding a dog into a boat; having a substantially vertical wall portion extending from water upon which said boat is floating, said ramp comprising an inclined planar member having first and second ends opposite one another, said member including means for removably attaching said first end to said vertical wall portion of said boat and means for extending said member into the water; and means for aiding a dog onto said boat via said inclined planar member comprising a platform secured to the second end of said planar member and disposed entirely below the surface of said water when said inclined planar member is operably secured to said boat in said water wherein said platform is disposed in a substantially horizontal position when said inclined planar member is touched by a forward portion of said dog attempting to mount said boat from said water to accommodate a rearward portion of said dog to ease access of said dog into said boat without aid from any other source as the boat rolls during the mounting process into said boat by said dog.

2. A ramp for aiding an animal or human into a boat from the water comprising:

an inclined planar member;

a support member adjustably attached to one end of said inclined planar member and removably secured to a selected vertical wall of the boat to extend along the outer surface of said vertical wall and utilize said vertical wall to support the extension of said inclined planar member from said boat into said water; and means responsive to contact of said member by an animal or human disposed in the water for facilitating access to said boat by said animal or human comprising a platform integrated to the other end of said planar member to form the other end of said ramp opposite said support member and disposed below the water surface when said support member is secured to said selected vertical wall of said boat wherein any contact of said planar member by said animal or human disposes said platform in a substantially horizontal position below said animal or human to aid the animal or human in gaining access to said planar member and to the interior of said boat.

3. A ramp in accordance with claim 2, wherein said platform comprises a substantially horizontal portion and a substantially vertical portion and the plane formed by said vertical portion forms an angle with the plane formed by said inclined planar member that is less than a right angle.

4. A ramp in accordance with claim 3, wherein said angle is between 40 degrees and 70 degrees.

5. A ramp in accordance with claim 4, wherein said angle is approximately 55 degrees.

6. A ramp for aiding an animal into a boat from the water surrounding the boat comprising:

a planar member;

means for supporting said planar member on said boat comprising a support member adjustably attached to said planar member wherein said planar member may be positioned at various inclined locations relative to said support member, and means for removably attaching said support member to said boat;

planar means extending from one end of said planar member, said planar means having a planar portion forming an angle with said planar member, said portion being disposable below the surface of the water in a substantially horizontal position when said support member is attached to said boat, said planar means being responsive to contact with said planar member by said animal for facilitating access of said animal to association with said planar member to gain access to said boat in response to the movement of said boat.

7. A ramp in accordance with claim 6, wherein said ramp is also free-standing when not attached to said boat and disposed on a substantially horizontal planar support.

8. A ramp in accordance with claim 6, wherein said support member comprises a substantially vertically disposed first support and a second brace support and said planar member, first support and second brace support are adjustable relative to one another to dispose said planar member in a variety of inclined positions relative to said boat.

9. A ramp in accordance with claim 8, wherein said first support and said second brace support are relatively pivotable.

10. A ramp in accordance with claim 9, wherein said first support is adjustably secured to substantially one end of said planar member and said second brace support is adjustably secured to said planar member at a point intermediate the ends of said planar member.

11. A ramp in accordance with claim 6, wherein said planar member has a slip resistant upper surface.

12. A ramp in accordance with claim 6, wherein said planar means for facilitating access includes a slip resistant upper surface.

13. A ramp in accordance with claim 6, wherein said planar portion includes step means for facilitating travel up said inclined planar portion to said boat.

* * * * *